US009096993B2

(12) United States Patent
Gross et al.

(10) Patent No.: US 9,096,993 B2
(45) Date of Patent: Aug. 4, 2015

(54) DIPPER LATCH MECHANISM

(71) Applicant: Harnischfeger Technologies, Inc., Wilmington (DE)

(72) Inventors: Matthew L. Gross, West Allis, WI (US); Joseph J. Colwell, Hubertus, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 137 days.

(21) Appl. No.: 13/937,839

(22) Filed: Jul. 9, 2013

(65) Prior Publication Data

US 2014/0007469 A1 Jan. 9, 2014

Related U.S. Application Data

(60) Provisional application No. 61/669,371, filed on Jul. 9, 2012.

(51) Int. Cl.
*E02F 3/407* (2006.01)

(52) U.S. Cl.
CPC ..... *E02F 3/4075* (2013.01)

(58) Field of Classification Search
CPC ..... E02F 3/4075
USPC ..... 37/445
See application file for complete search history.

(56) References Cited

U.S. PATENT DOCUMENTS

| | | | |
|---|---|---|---|
| 3,059,793 | A | 10/1962 | Atkinson et al. |
| 3,647,248 | A | 3/1972 | Ferris et al. |
| 5,815,958 | A | 10/1998 | Olds et al. |
| 6,219,946 | B1 | 4/2001 | Soczka |
| 8,136,272 | B2 | 3/2012 | Hren et al. |
| 2010/0095562 | A1 | 4/2010 | Medel et al. |
| 2012/0192465 | A1 | 8/2012 | Opazo |

OTHER PUBLICATIONS

International Search Report and Written Opinion for Application No. PCT/US2013/049749 dated Dec. 20, 2013 (16 pages).

*Primary Examiner* — Matthew D Troutman
(74) *Attorney, Agent, or Firm* — Michael Best & Friedrich LLP

(57) ABSTRACT

A dipper assembly includes a body defining an outer surface and an opening, a door pivotably coupled to the body, and a latch mechanism releasably securing the door relative to the body. The door is pivotable between a closed position in which the door is positioned adjacent the opening and an open position in which the door is positioned away from the opening. The latch mechanism includes a latchkeeper and a latch member engaging the latchkeeper. The latch member is coupled to one of the body and the door and the latchkeeper is coupled to the other of the body and the door. The latchkeeper includes an end surface and a stop member coupled to the end surface. The stop member engages the one of the body and the door when the door is in the closed position. The stop member is extendable relative to the end surface.

23 Claims, 10 Drawing Sheets

DIPPER LATCH MECHANISM

CROSS-REFERENCE TO RELATED APPLICATIONS

This application claims the benefit of U.S. Provisional Patent Application No. 61/669,371, filed Jul. 9, 2012, the entire contents of which are incorporated herein by reference.

BACKGROUND

The present invention relates to the field of mining shovels. Specifically, the present invention discloses a dipper door latch mechanism.

A conventional mining shovel includes a dipper having a dipper door pivotably coupled to a dipper body. During operation, the shovel operator releases the door to unload the contents of the dipper. The operator then moves the dipper into a tuck position so that the door falls back against the dipper body. The door slams shut, and a latch mechanism secures the door against the dipper body. This closing operation results in large impact loads and vibrations in the dipper door and the latch mechanism. In addition, as the dipper moves through an embankment of material, rocks and other debris can enter the latch mechanism's housing. These loads and contaminants cause components of the dipper and the latch mechanism to wear out and require more frequent maintenance.

SUMMARY

In one embodiment, the invention provides dipper assembly for a mining shovel. The dipper assembly includes a body defining an outer surface and an opening, a door pivotably coupled to the body, and a latch mechanism releasably securing the door relative to the body. The door is pivotable between a closed position in which the door is positioned adjacent the opening and an open position in which the door is positioned away from the opening. The latch mechanism includes a latchkeeper and a latch member engaging the latchkeeper. The latch member is coupled to one of the body and the door and the latchkeeper is coupled to the other of the body and the door. The latchkeeper includes an end surface and a stop member coupled to the end surface. The stop member engages the one of the body and the door when the door is in the closed position. The stop member is extendable relative to the end surface.

In another embodiment, the invention provides a dipper assembly for a mining shovel. The dipper assembly includes a body defining an outer surface and an opening, a door pivotably coupled to the body, a latch member coupled to the door, and a latchkeeper. The door is pivotable between a closed position in which the door is positioned adjacent the opening and an open position in which the door is positioned away from the opening. The latchkeeper is positioned on the body proximate the opening and the latchkeeper engages the latch member to releasably secure the door in the closed position against the body. The latchkeeper includes an end surface and a stop member coupled to the end surface. The stop member includes a stop surface abutting the door when the door is in the closed position. The stop surface is extendable relative to the end surface.

In yet another embodiment, the invention provides a dipper assembly for a mining shovel. The dipper assembly includes a body defining an outer surface and an opening, a door pivotably coupled to the body, a latch member coupled to one of the body and the door, a latchkeeper coupled to the other of the body and the door, and a stop member. The door is pivotable between a closed position in which the door is positioned adjacent the opening and an open position in which the door is positioned away from the opening. The latchkeeper includes a cutout for receiving a portion of the latch member, an end surface, and a recess positioned on the end surface. The recess has an inner end surface. The stop member is positioned within the recess of the latchkeeper and includes a cap and a core. The cap defines a stop surface spaced apart from the end surface and extendable relative to the end surface. The core is positioned between the cap and the inner end surface of the recess.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

Figure 1:
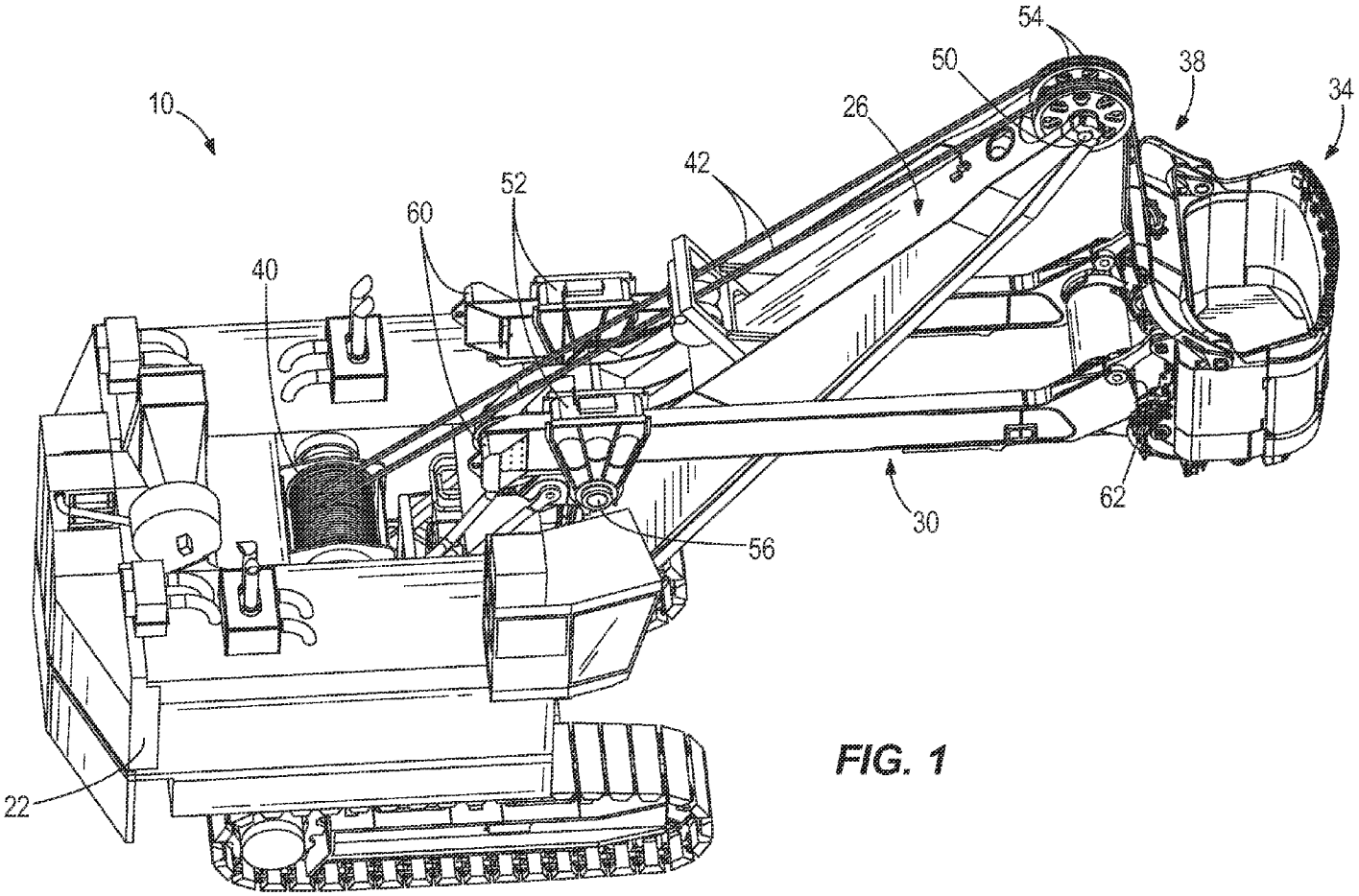
FIG. 1 is a perspective view of a mining shovel.

As shown in FIG. 1, an earthmoving machine such as a mining shovel 10 including a base 22, a boom 26, an elongated member or handle 30 moveably coupled to the boom 26, a dipper 34, and a bail assembly 38 coupled to the dipper 34. The base 22 includes a hoist drum 40 for reeling in and paying out a cable or rope 42. The boom 26 includes a first end (not shown) coupled to the base 22, a second end 50 positioned away from the base 22, saddle blocks 52, a boom sheave 54 coupled to the second end 50, and a shipper shaft 56. In the illustrated embodiment, a support member (not shown) limits or dampens the pivoting movement of the boom 26 relative to the base 22. In other embodiments, the boom 26 is supported by a gantry or similar structure.

The handle 30 is moveably coupled to the boom 26 and includes a first end 60 and a second end 62. The first end 60 is movably received in the saddle blocks 52, and the handle passes through the saddle block 52 such that the handle 30 is configured for rotational and translational movement relative to the boom 26. State another way, the handle 30 is linearly extendable relative to the saddle block 52 and is rotatable about the shipper shaft 56.

The rope 42 is secured to the hoist drum, passes over the boom sheave 54, and is coupled to the dipper 34 by the bail assembly 38. The dipper 34 is raised or lowered relative to the boom sheave 54 as the rope 42 is reeled in or paid out, respectively, by the hoist drum. In the illustrated embodiment, the dipper 34 is fixed relative to the handle 30. In other embodiments, the bucket or dipper 34 is pivotable relative to the handle 30 about the second end 62.

Figure 2:
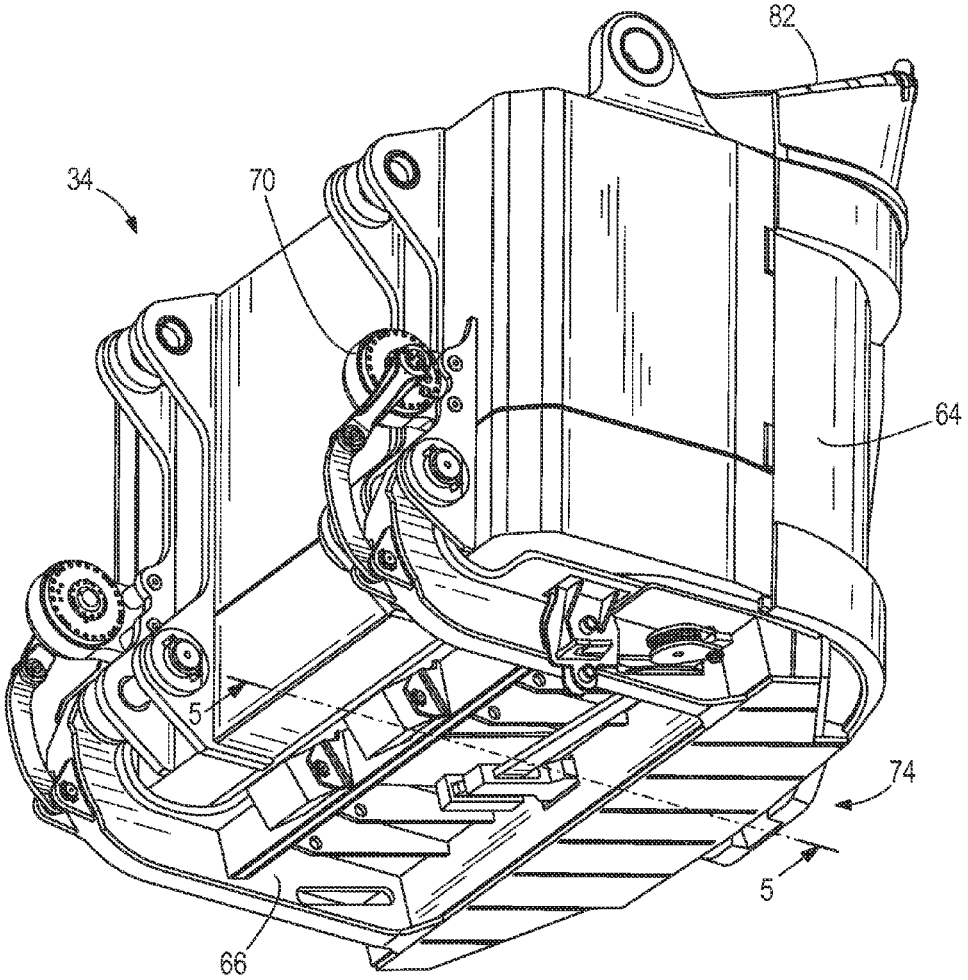
FIG. 2 is a perspective view of a dipper with a dipper door in a closed position.
Figure 3:
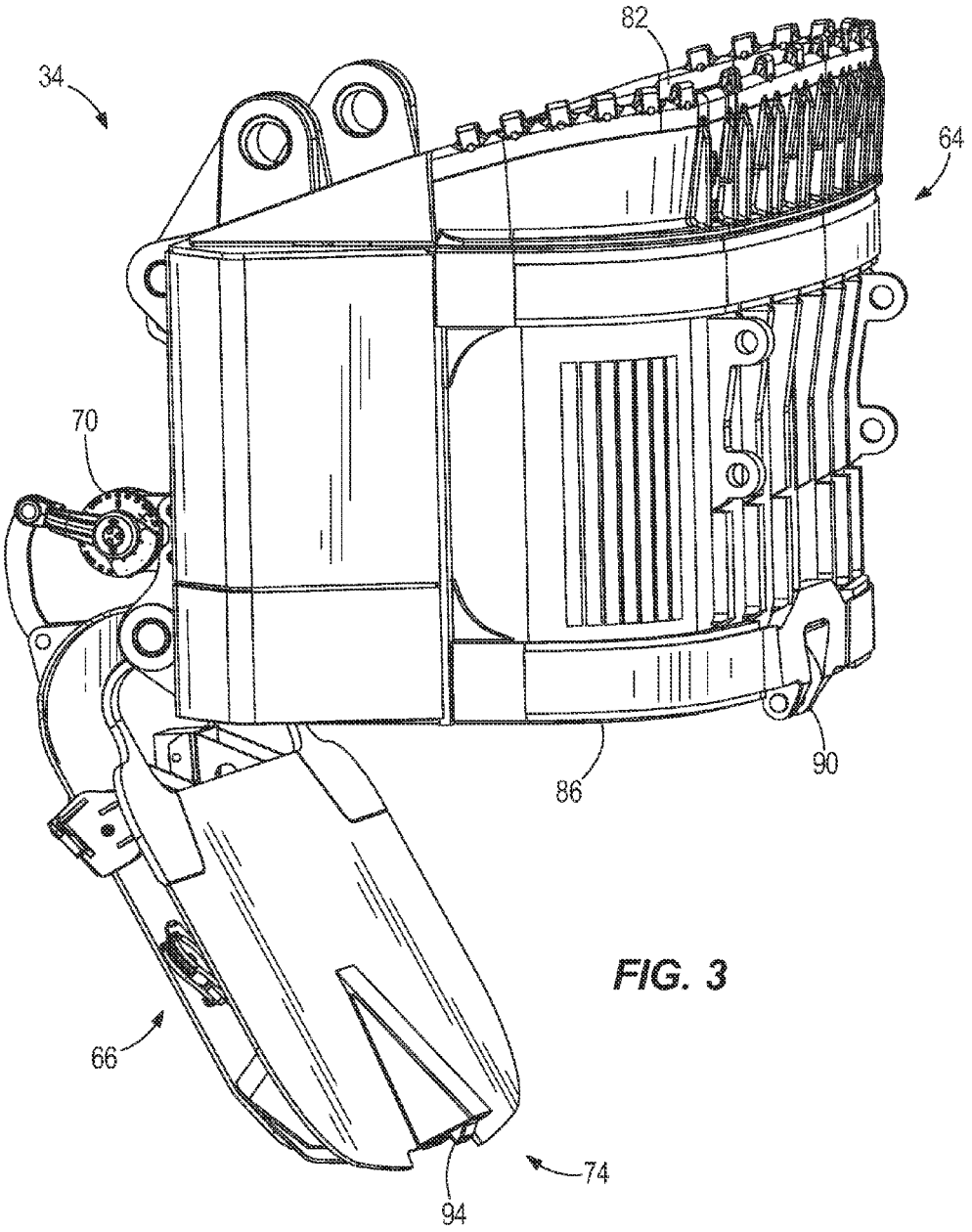
FIG. 3 is a perspective view of the dipper of FIG. 2 with the dipper door in an open position.

Referring to FIGS. 2 and 3, the dipper 34 includes a dipper body 64, a dipper door 66 pivotably coupled to the dipper body 64, a fluid damper or snubber 70 for dampening the motion of the dipper door 66, and a latch mechanism 74 (FIG. 3) for releasably securing the dipper door 66 to the dipper body 64. In the illustrated embodiment, the dipper body 64 includes a first or material receiving opening 82 and a second or material discharging opening 86. The dipper door 66 pivots between a first or closed position (FIG. 2) to close the discharging opening 86 and a second or open position (FIG. 3) to open the discharging opening 86 and release the contents of the dipper body 64.

Figure 4:
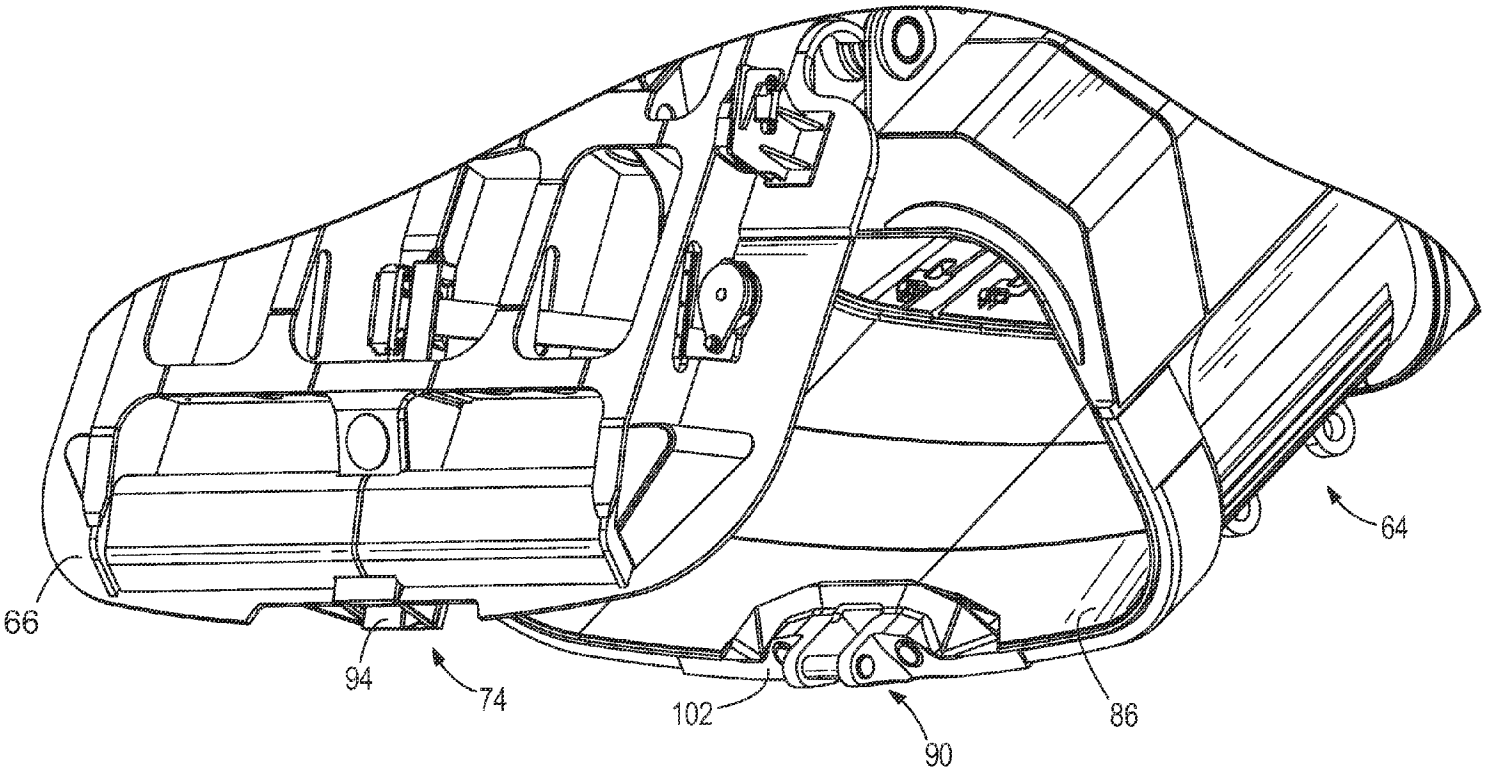
FIG. 4 is a perspective view of a lower portion of the dipper of FIG. 2.
Figure 5:
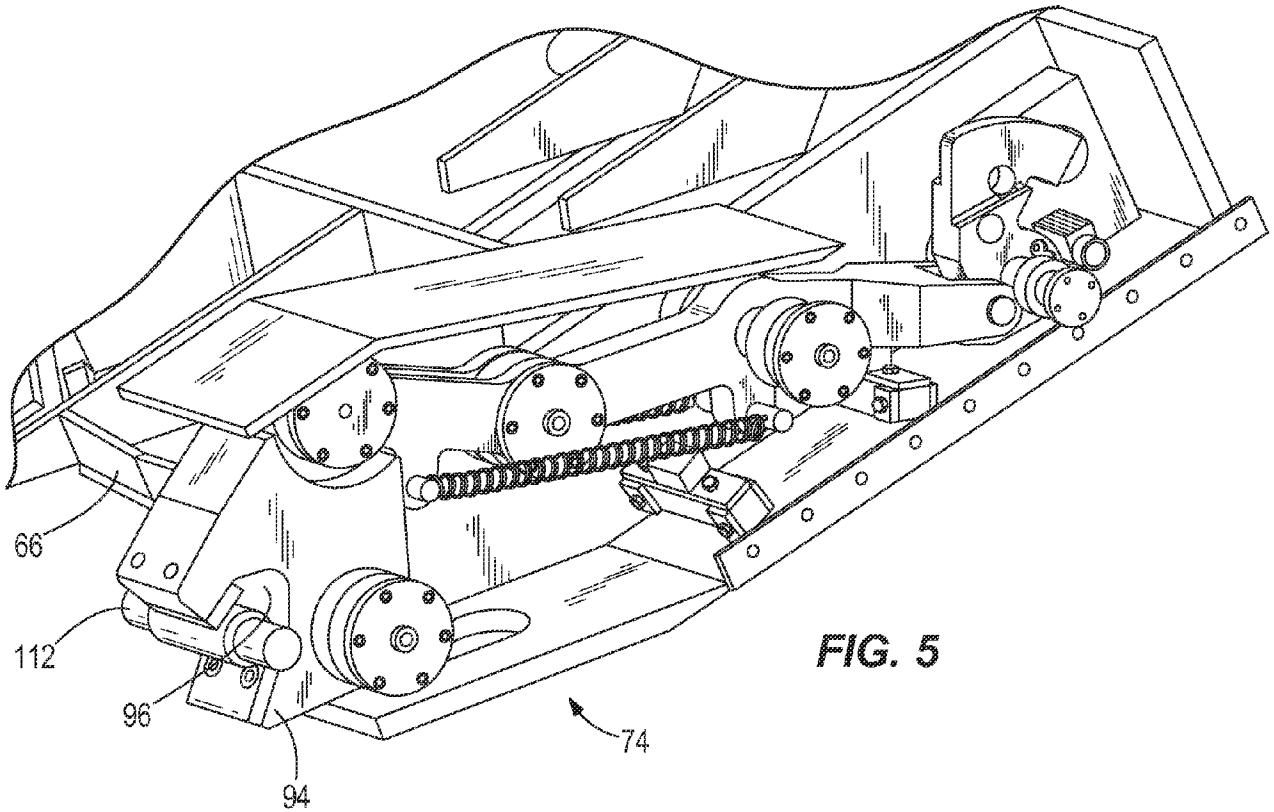
FIG. 5 is a section view of a portion of the dipper of FIG. 2 showing a latch mechanism, viewed along line 5-5.
Figure 6:
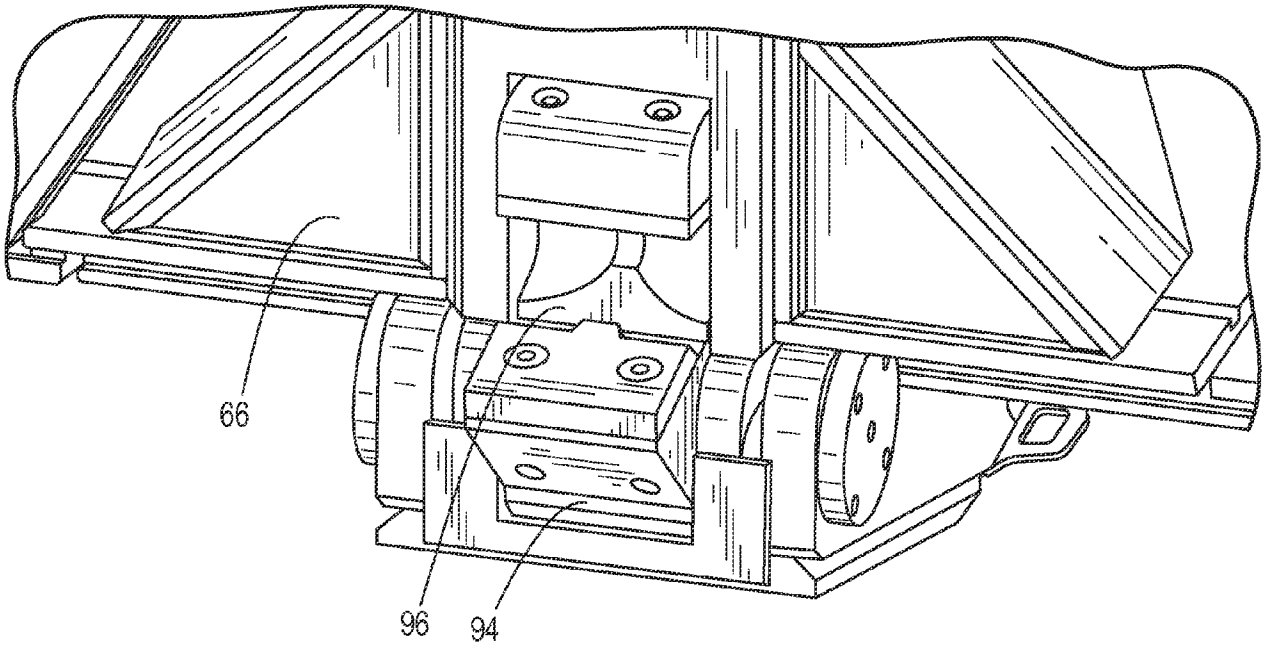
FIG. 6 is an enlarged perspective view of the latch mechanism of FIG. 5.

In the illustrated embodiment shown in FIGS. 3 and 4, the latch mechanism 74 includes a latchkeeper 90 supporting a latch pin 112 and a latch member 94 for engaging the latchkeeper 90. In other embodiments, the latchkeeper 90 may include a cutout having an inclined surface for receiving a latch lever or bar. In the illustrated embodiment, the latch member 94 is positioned on the door 66 and is pivotable relative to the door 66 between a released position and a locked position. Referring to FIGS. 5 and 6, the latch member 94 includes a jaw 96 and is pivotable to engage the latch pin 112 (FIG. 5). In one embodiment, the latch mechanism 70 is similar to the dipper latch mechanism described in U.S. patent application Ser. No. 12/986,933, filed Jan. 7, 2011, the entire contents of which are incorporated herein by reference. In other embodiments, the latch mechanism may include a latch lever or bar and the latchkeeper includes a surface defining a cutout, and the latch bar is movable to selectively engage the cutout. The latch lever is slidably mounted to the dipper door 66 and is moved by pulling the latch lever out of engagement with the latch pin 112.

Figure 7:
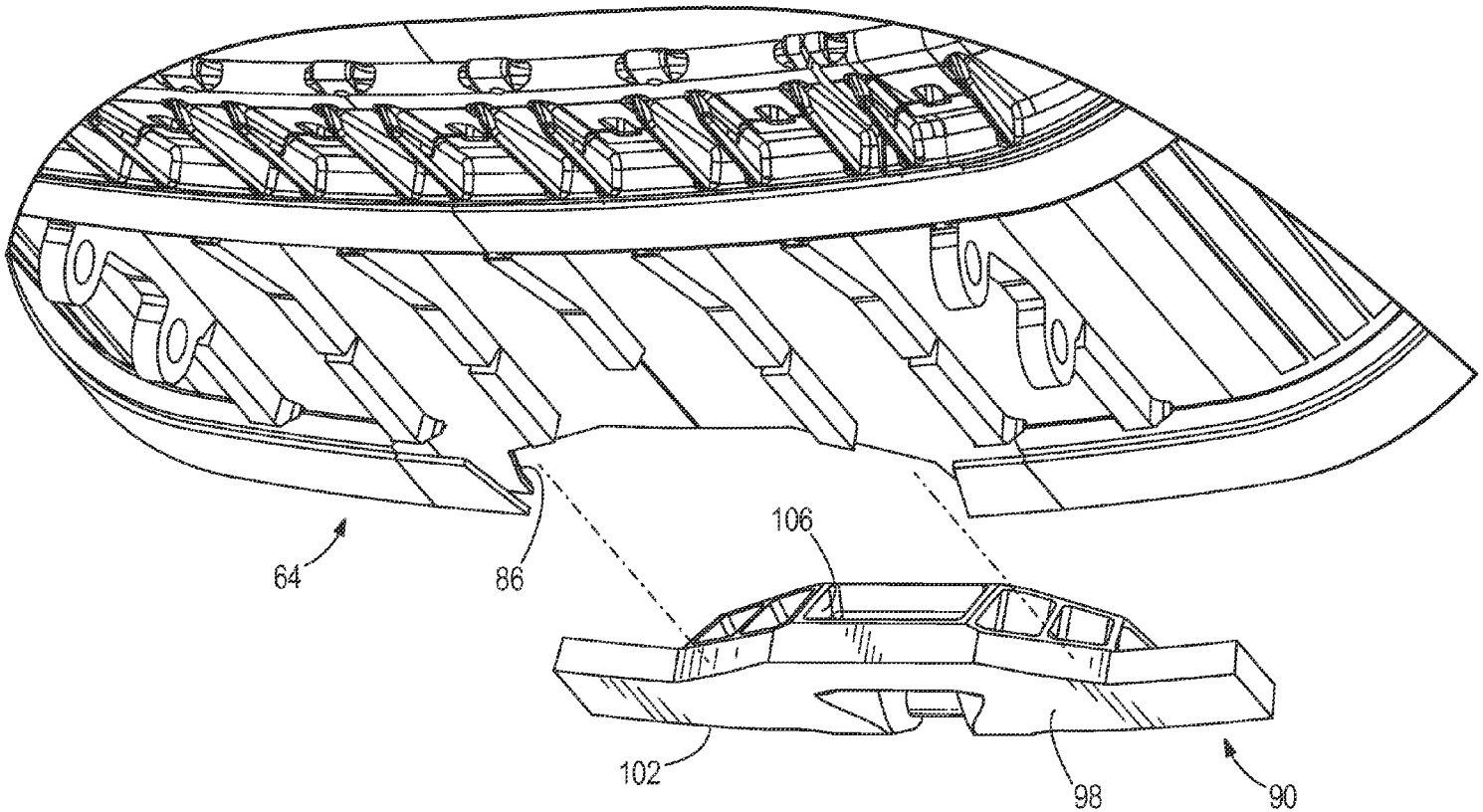
FIG. 7 is a partial exploded view of a dipper body.

Referring to FIG. 7, the latchkeeper 90 includes an elongated body 98 defining an end surface or first side 102 and a second side 106. The second side 106 is coupled to the dipper body 64 proximate the material discharging opening 86 and the first side 102 is positioned to engage the latch member 94 (FIG. 3) when the door 66 is closed.

Figure 8:
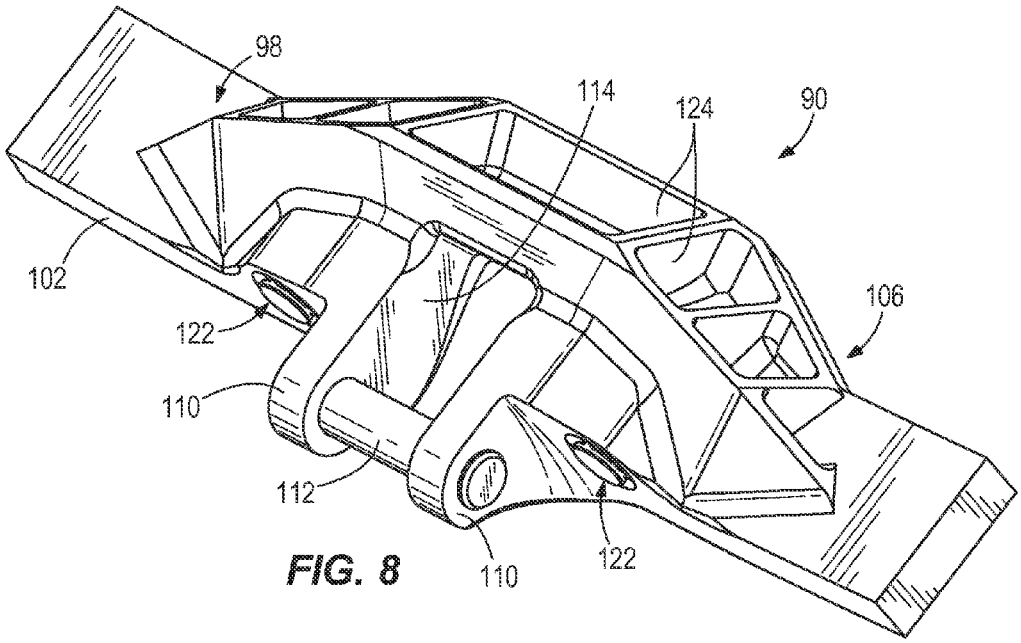
FIG. 8 is a rear perspective view of a latchkeeper.
Figure 10:
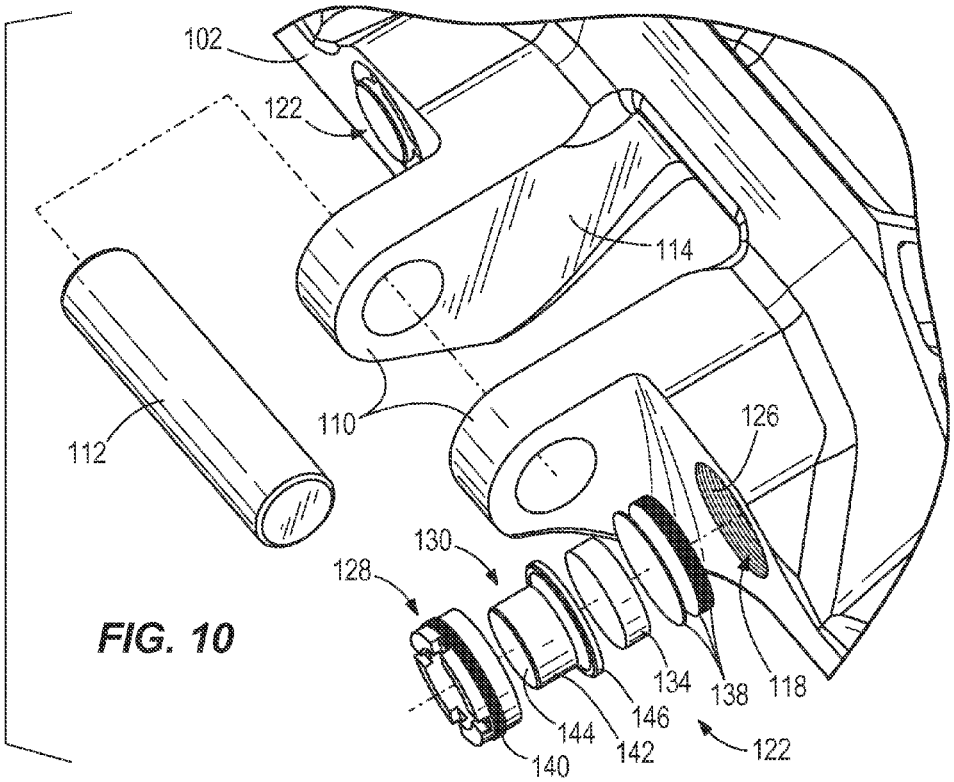
FIG. 10 is an exploded view of the latchkeeper of FIG. 8.
Figure 9:
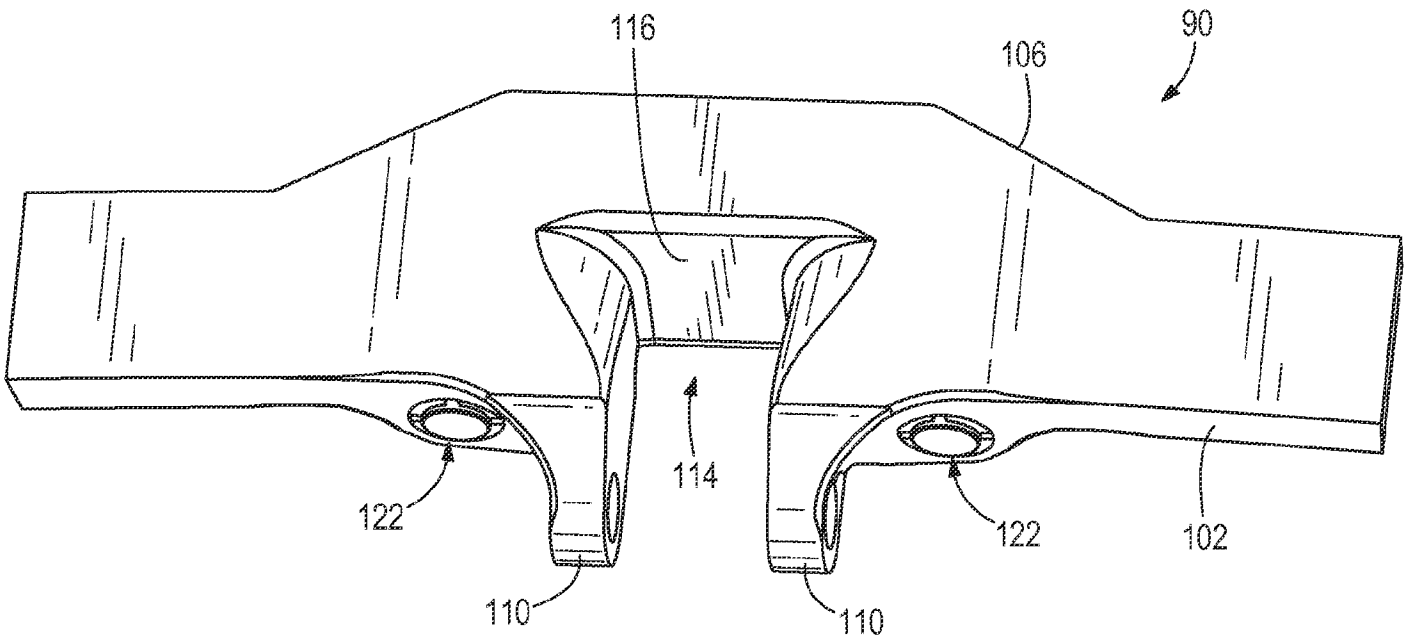
FIG. 9 is a front perspective view of the latchkeeper of FIG. 8.

As shown in FIGS. 8 and 9, the latchkeeper 90 includes a pair of lugs 110 extending from the first side 102, a pin 112 supported by the lugs 110, a cutout 114 positioned between the lugs 110, a pair of slots or recesses 118 positioned on the first side 102, a stop member or bumper assembly 122 received within each recess 118, and cavities 124 positioned on the second side 106. As shown in FIGS. 3 and 4, the lugs 110 and the cutout 114 extend inwardly from the outer surface of the dipper body 64 so that the latchkeeper 90 does not drag against the dug material as the dipper 34 is moved through an embankment. The cutout 114 is positioned to receive a portion of the latch member 94 when the door 66 is closed. As best shown in FIG. 9, the cutout 114 is defined between the lugs 110 and an end surface 116 proximate second side 106. As best shown in FIG. 10, each recess 118 is positioned proximate one of the lugs 110 and includes an internal threaded surface 126. In the illustrated embodiment, the latchkeeper 90 is a unitary piece, formed by a casting process, for example.

As shown in FIG. 10, each bumper assembly 122 includes a collar 128, a piston or cap 130, a bumper core 134, and multiple shims 138. In the illustrated embodiment, the collar 128 is generally annular-shaped and includes an external threaded surface 140 for engaging the internal threaded surface 126 to retain the bumper assembly 122 within the recess 118. In other embodiments, the bumper assembly 122 is retained within the recess 118 by another type of mechanical coupling. The cap 130 includes a protrusion 142, a stop surface 144 on one end of the protrusion 142, and a flange 146 proximate another end of the protrusion 142. The protrusion 142 extends through the center of the collar 128, and the flange 146 is positioned between the collar 128 and the core 134. In the illustrated embodiment, the cap 130 is formed from metal, and the core 134 is formed from polyurethane. In other embodiments, the core 134 may be formed from another material that is significantly more easily compressed than the cap 130 or the shims 138. The shims 138 are positioned between the core 134 and an inner end surface 150 (FIGS. 11 and 12) of the recess 118.

Figure 12:
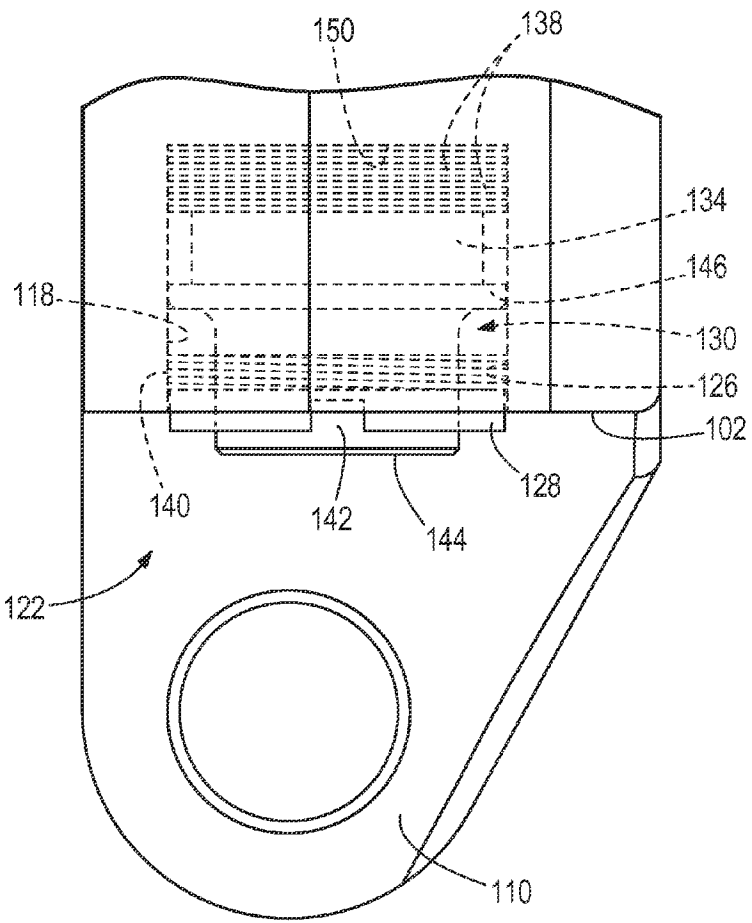
FIG. 12 is a left side view of the latchkeeper of FIG. 8 with the door stop in an extended position.
Figure 11:
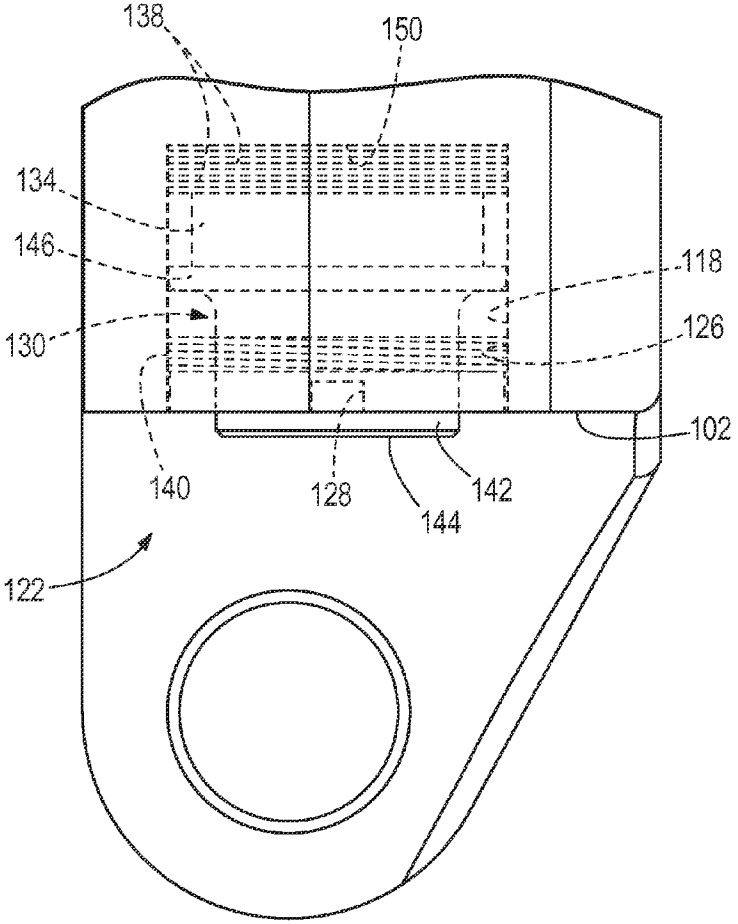
FIG. 11 is a left side view of the latchkeeper of FIG. 8 with a door stop in a retracted position.

The bumper assembly 122 is formed by first inserting the shims 138 into the recesses 118, and then inserting the core 134 on top of the shims 138. The cap 130 is positioned on top of the core 134. Finally, the collar 128 is placed over the protrusion 142 of the cap 130, and the external threads 142 are screwed into the internal threaded surface 126 until the collar 128 is tight against the cap 130. Shims 138 can be added or removed to adjust the extension of the bumper assembly 122 relative to the first side 102. For example, as shown in FIGS. 11 and 12, fewer shims 138 causes the stop surface 144 of the cap 130 to be positioned closer to the first side 102 (FIG. 11), while additional shims 138 cause the stop surface 144 of the cap 130 to extend further outwardly relative to the first side 102 (FIG. 12). In other embodiments, the cap 130 may be formed with a bore for receiving the core 134 and, optionally, at least one secondary shim such that and adding or removing the secondary shims would adjust the position of the stop surface.

During operation of the shovel 10, the operator closes the dipper door 66 by moving the dipper 34 into a tuck position. The dipper door 66 falls toward the dipper body 64 such that the door 66 falls against the first side 102 of the latchkeeper 90 and against the stop surface 144. The bumper assembly 122 engages the door 66, absorbing the impact of the door 66. The latch member 94 engages the pin 112 to secure the door 66 relative to the dipper body 64. The core 134 provides a wear element that absorbs the compression force of the door 66. Due to space within the recess 118 surrounding the core 134 and positioned between the shims 138 and the cap 130, the core 134 can be partially compressed within the recess 118 until the core 134 is deformed to the point that the core 134 occupies the space within the recess 118 surrounding the core 134.

The bumper assembly 122 reduces the acceleration associated with closing the dipper door 66, thereby reducing the forces and vibrations that arise due to the impact of the dipper door 66. The bumper assembly 122 therefore reduces wear on the door 66 and improves the working life of the dipper 64 and door 66. The softer closing operation reduces wear on the dipper door 66 by reducing or eliminating the metal-on-metal contact between the dipper body 64 and the door 66 or any of the door components. The bumper assembly 122 substantially absorbs the closing energy of the door 66. If the snubber 70 fails, the force of the dipper door 66 closing substantially compresses core 134 of the bumper assembly 122 such that the core 134 and the cap 130 are pressed against the inner end 150 of the recesses 118. This compression of the bumper assembly 122 provides a rigid connection between the closing dipper door 66 and the dipper body 64, thereby providing a "hard" door stop position. This "hard" stop position is adjustable and can be controlled through the dimensions of the components of the bumper assembly 122 and the recesses 118, and/or by changing the number of shims 138 within the recess 118.

In addition, the stop surface 144 of the bumper assembly 122 defines a "door-closed" position that can be easily calibrated, instead of requiring the door 66 to be slammed against the dipper body 64 to insure that the door 66 is closed. The extension of each bumper assembly 122 is adjusted by inserting or removing shims 138, thereby permitting the door-closed position to be adjusted and allowing the door 66 to operate properly in various conditions. Also, the adjustability eliminates the need to precisely align the latchkeeper 90 and latch member 94 when assembling the dipper 34. Instead, the extension of the bumper assembly 122 can be adjusted after the latchkeeper 90 is mounted on the dipper 34 in order to calibrate the engagement between the latch member 94 and the latchkeeper 90.

Furthermore, the geometry of the latchkeeper 90 shields the latch pin 112 from abrasive wear and material wear during the opening and closing operations of the door 66, thereby improving the working life of the latch pin 112. In particular, the end surface 116 of the cutout 114 acts a shield to deflect dug material from impacting the latch 122 or otherwise penetrating into the latch mechanism 74. The latchkeeper 90 therefore does not require a "rock box", or a separate structure to protect the latchkeeper 90 from material flow or other abrasions caused by the debris as the dipper 34 moves through the embankment. In addition, as best shown in FIGS. 3 and 4, the latchkeeper 90 extends inwardly from an outer surface of the dipper body 64, thereby preventing the latchkeeper 90 from dragging as the dipper 34 is hoisted through the bank.

The latchkeeper 90 utilizes a compact and lightweight design that improves the cutting force exerted by the dipper 34 and the payload carried by the dipper 34. In other embodiments, the latch member 94 is positioned on the dipper body 64 and the latchkeeper 90 is positioned on the dipper door 66. In still other embodiments, the latch mechanism 74 could include a latch bar to engage a latchkeeper similar to the latchkeeper 90 shown in FIG. 8, including the bumper assembly 122 and a similar geometry to eliminate the need for a separate "rock box."

Thus, the invention provides, among other things, a latchkeeper for a shovel dipper. Although the invention has been described in detail with reference to certain preferred embodiments, variations and modifications exist within the scope and spirit of one or more independent aspects of the invention as described.

What is claimed is:

1. A dipper assembly for a mining shovel, the dipper assembly comprising:

a body defining an outer surface and an opening;

a door pivotably coupled to the body, the door pivotable between a closed position in which the door is positioned adjacent the opening and an open position in which the door is positioned away from the opening; and a latch mechanism releasably securing the door relative to the body, the latch mechanism including a latchkeeper and a latch member engaging the latchkeeper, the latch member being coupled to one of the body and the door and the latchkeeper being coupled to the other of the body and the door, the latchkeeper including an end surface and a stop member coupled to the end surface, the stop member engaging the one of the body and the door when the door is in the closed position, the stop member being extendable relative to the end surface.

2. The dipper assembly of claim 1, wherein the latch member includes a rotating jaw and the latchkeeper includes a latch pin received within the jaw to releasably secure the door relative to the body.

3. The dipper assembly of claim 1, wherein the latchkeeper is coupled to the dipper body and the stop member defines the closed position of the door.

4. The dipper assembly of claim 1, further comprising a damper for dampening the movement of the door relative to the body, wherein when the damper fails the closing motion of the door compresses the stop member to a fully retracted position.

5. The dipper assembly of claim 1, further comprising a slot on the end surface, the stop member positioned within the slot, the stop member including a cap having a stop surface spaced apart from the end surface, the stop surface engaging the one of the body and the door when the door is in the closed position.

6. The dipper assembly of claim 5, wherein the slot includes an inner end surface, the stop member including a core positioned between the cap and the inner end surface.

7. The dipper assembly of claim 6, wherein the core is formed from polyurethane.

8. The dipper assembly of claim 5, wherein the stop member further includes at least one shim positioned between the cap and the inner end surface of the slot to extend the stop surface away from the end surface.

9. The dipper assembly of claim 3, wherein the latchkeeper includes a cutout for receiving a portion of the latch member, the cutout being angled inwardly from an outer surface of the body.

10. The dipper assembly of claim 9, wherein the latchkeeper includes a pair of lugs extending from the end surface, wherein the cutout is defined by a space between the lugs.

11. A dipper assembly for a mining shovel, the dipper assembly comprising:

a body defining an outer surface and an opening;

a door pivotably coupled to the body, the door pivotable between a closed position in which the door is positioned adjacent the opening and an open position in which the door is positioned away from the opening;

a latch member coupled to the door; and a latchkeeper positioned on the body proximate the opening and engaging the latch member to releasably secure the door in the closed position against the body, the latchkeeper including an end surface and a stop member coupled to the end surface, the stop member including a stop surface abutting the door when the door is in the closed position, the stop surface being extendable relative to the end surface.

12. The dipper assembly of claim 11, wherein the latch member includes a rotating jaw and the latchkeeper includes a latch pin received within the jaw to releasably secure the door relative to the body.

13. The dipper assembly of claim 11, further comprising a damper for dampening the movement of the door relative to the body, wherein when the damper fails the closing motion of the door compresses the stop member to a fully retracted position.

14. The dipper assembly of claim 11, further comprising a slot on the end surface, the stop member positioned within the slot, the stop member including a cap defining the stop surface, the stop surface being spaced apart from the end surface.

15. The dipper assembly of claim 14, wherein the slot includes an inner end surface, the stop member including a core positioned between the stop surface and the inner end surface.

16. The dipper assembly of claim 15, wherein the core is formed from polyurethane.

17. The dipper assembly of claim 15, wherein the stop member further includes at least one shim positioned between the cap and the inner end surface of the slot to extend the stop surface away from the end surface.

18. The dipper assembly of claim 11, wherein the latchkeeper further includes a cutout for receiving a portion of the latch member, the cutout being angled inwardly from an outer surface of the body.

19. A dipper assembly for a mining shovel, the dipper assembly comprising:

a body defining an outer surface and an opening;

a door pivotably coupled to the body, the door pivotable between a closed position in which the door is positioned adjacent the opening and an open position in which the door is positioned away from the opening;

a latch member coupled to one of the body and the door;

a latchkeeper coupled to the other of the body and the door, the latchkeeper including a cutout for receiving a portion of the latch member, an end surface, and a recess positioned on the end surface, the recess having an inner end surface; and a stop member positioned within the recess of the latchkeeper, the stop member including a cap and a core, the cap defining a stop surface spaced apart from the end surface and extendable relative to the end surface, the core being positioned between the cap and the inner end surface of the recess.

20. The dipper assembly of claim 19, wherein the latch member includes a rotating jaw and the latchkeeper includes a latch pin received within the jaw to releasably secure the door relative to the body.

21. The dipper assembly of claim 19, wherein the core is formed from polyurethane.

22. The dipper assembly of claim 19, wherein the stop member further includes at least one shim positioned between the cap and the inner end surface of the recess to extend the stop surface away from the end surface.

23. The dipper assembly of claim 19, wherein the cutout is angled inwardly from an outer surface of the body.

* * * * *